United States Patent [19]

Bachmann

[11] 4,286,454

[45] Sep. 1, 1981

[54] APPARATUS FOR FORGING SHAFT FLANGES

[75] Inventor: Horst Bachmann, Rödental-Waldsachsen, Fed. Rep. of Germany

[73] Assignee: Langenstein & Schemann Aktiengesellschaft, Fed. Rep. of Germany

[21] Appl. No.: 59,162

[22] Filed: Jul. 20, 1979

[30] Foreign Application Priority Data

Jul. 28, 1978 [DE] Fed. Rep. of Germany ..... 2833181

[51] Int. Cl.[3] ..... B21D 43/14

[52] U.S. Cl. ..... 72/356; 10/13; 72/419; 72/454

[58] Field of Search ..... 72/356, 454, 404, 419; 10/13; 100/289

[56] References Cited

U.S. PATENT DOCUMENTS

| | | | |
|---|---|---|---|
| 1,964,434 | 6/1934 | Holmes | 10/13 |
| 2,016,239 | 10/1935 | Ford | 10/13 |
| 3,030,642 | 4/1962 | Fray | 10/13 |
| 3,245,097 | 4/1966 | Domingo | 10/13 |
| 3,786,743 | 1/1974 | Dischler | 100/289 |
| 3,842,652 | 10/1974 | Yonezawa | 72/454 |

*Primary Examiner*—Nicholas P. Godici
*Assistant Examiner*—Gene P. Crosby
*Attorney, Agent, or Firm*—Holman & Stern

[57] ABSTRACT

Apparatus for forging a shaft flange comprises a forging press having a fixed plate and a moving platen. The moving platen carries a finish-forging die as well as a plurality of upper preforming dies while the fixed plate carries a rotary table having a series of like lower dies arranged in a circle. In use, a workpiece is carried by one of the lower dies sequentially into engagement with the upper preforming dies and the finish-forging die by rotational indexing movements of the table so that both the preforming forging operations as well as the finish forging operation are carried out in the same press. The finish-forging die is located substantially on the central axis of the press frame and the rotational axis of the table is spaced from this central axis.

7 Claims, 7 Drawing Figures

APPARATUS FOR FORGING SHAFT FLANGES

BRIEF SUMMARY OF THE INVENTION

The invention relates to apparatus for forging shaft flanges by performing preforming and finish-forging operations, the apparatus comprising a forging press in which a moving platen is moveable back and forth on a support with respect to a press plate which supports a rotatably mounted table; whereby for the finish-forging operation an upper and a lower die are disposed on the moving platen and the table, respectively, approximately centrally of the support stand area, the shape of said dies corresponding to that of the shaft flange which is to be produced; and whereby the lower die is adapted for feeding the shaft of the workpiece using the rotated table.

With a known device of this type (see for example, vol. 93, no. 6 of the journal *Industrie-Anzeiger*, p. 1697) the forging press is a standing screw press which only has an upper and lower die unit for a finish-forging operation, wherein the table is tiltable through about 90° around a horizontal axis in order to insert the relatively long shaft of the workpiece into the lower die, said shaft already having the preformed "raw flange" on it preparatory to the finish-forging operation. The forming of the "raw flange" is performed on a separately provided electrical upsetting machine by downwardly upsetting a raw workpiece in the form of a rod or bar. By a flange is meant, any flange-like form as well as a thickening for a drive shaft. A disadvantage of the known device is that an electrical upsetting machine, external to the forging press, is needed, which not only is costly in itself but also involves a relatively inefficient transfer of the unfinished workpiece from the electrical upsetting machine to the forging press.

One object of the present invention is thus to devise apparatus of the above-described type in which the shaft flange is produced economically using only a forging press, i.e., with high productivity, with only one series of impacts on the workpiece, and using simple tools.

According to the invention, apparatus of the type described is characterized in that the table is a rotating table with a rotational axis in the center area, which table extends beyond the operating region of the moving platen, and on both sides of the upper and lower die unit for the finish-forging operation, on a circle around the rotational axis of the rotary table, there are mounted upper and lower die units for performing operations which precede the finish-forging operation, i.e., the first preforming die combination is on the circle on one side and the second preforming die combination is on the circle on the other side; wherein all the lower dies are alike and the upper dies for the preforming operations are in the form of hollow cones for performing an upsetting operation and wherein upper dies are carried by the moving platen and lower dies by the rotary table. The raw workpiece in the form of a rod or bar is pre-heated at its end and inserted into one of the lower dies which is outside or extends outside the operating region of the moving platen, the insertion being via the cold region of the workpiece, in the direction of motion of the moving platen. Then this lower die with the raw workpiece is rotated under the upper die for the first forming operation, in which a first upsetting of the end part of the workpiece which extends from the lower die is performed. The lower die with the workpiece is then swung under the upper die for the second forming operation, and a second upsetting step is performed. Finally, the workpiece is rotated under the finish-forging upper die disposed in the middle of the cross sectional space of the forging press, and after finish-forging it is rotated back to a position outside the support area, where it is removed from the lower die. In each of these rotational steps the other two lower dies take up other positions, in which the workpieces in these latter dies also are correspondingly upset, finish-forged, inserted, or removed.

Thus, the forging press does not perform just one upsetting or finish-forging operation. Since there are at least three lower dies, multiple workpieces can be handled. Further, with only two lower dies the rotary work table cannot be rotated and positioned so that two workpieces simultaneously undergo forming with each operating stroke of the press bar. At least three lower dies are needed for this.

The forging press is, for example, a hydraulic impact forging press which can either press or hammer, whereby conceivably such a press may be horizontal. Ordinarily the forging press will be a screw press with a flywheel mass, since the rotary table does not need to sustain high acceleration, and a screw press is better suited for performing preforming and final forming operations simultaneously. A screw press as a rule is disposed upright, with the screw running vertically, for example, whereby the screw may act directly on the press platen. A grooved screw press with an oblique or horizontal screw is also well suited.

It is advantageous for the rotation of one of the lower dies to go from the first preforming position to the second preforming position, passing the finish-forging upper die. This manner of rotating the rotary table enables a sequence in which two workpieces may be moved in one rotational step from a position in which they have been preformed, finish-forged, removed, or inserted, to a second position in which they are also preformed, finish-forged, removed, or inserted.

It is particularly advantageous for there to be three angularly equidistant lower dies. In particulr, four lower dies do not allow a satisfactory sequence, and the rotary table can accommodate more than four lower dies only with difficulty.

It is also advantageous if an upper die for one of the preforming operations is positioned outside the cross sectional area of the support. Such an eccentric positioning of the upper die is permissible for preforming, it obviates increasing the size of the forging press, and it permits sufficient sideways displacement of the lower die for the workpieces to be readily inserted and removed.

DETAILED DESCRIPTION

Figure 1:
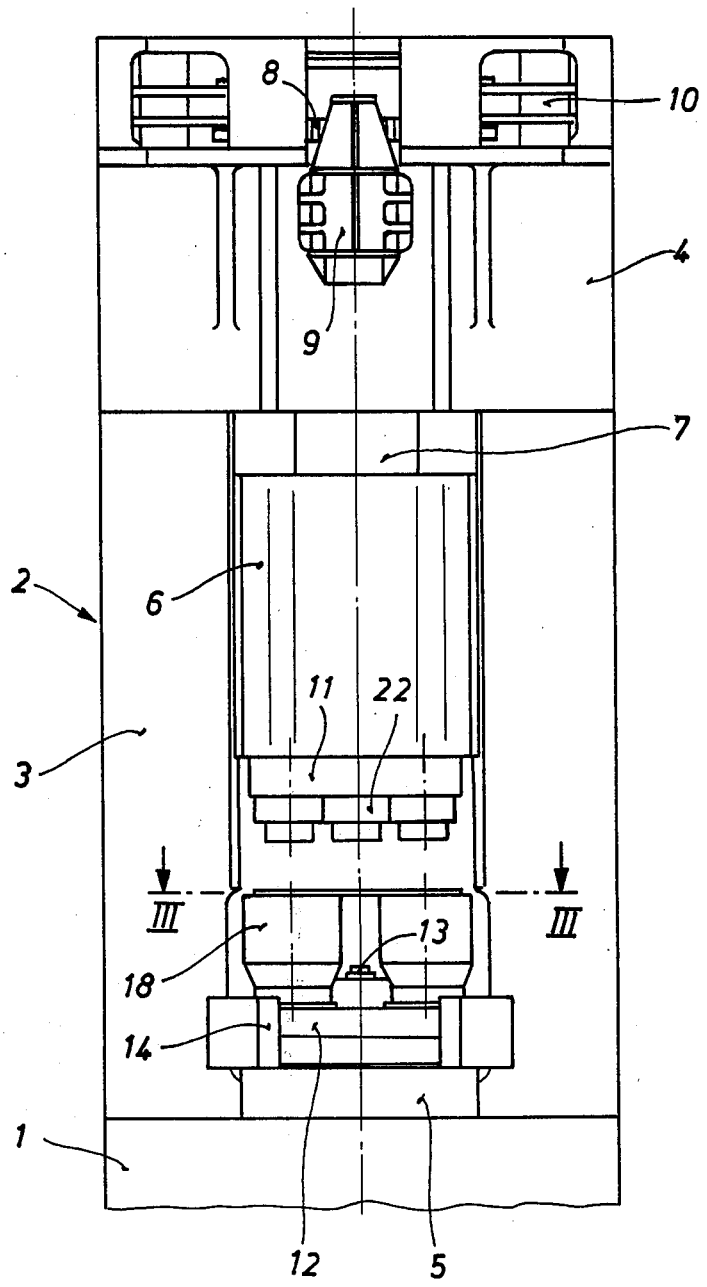
FIG. 1 is a front view of apparatus for forging a shaft flange.
Figure 2:
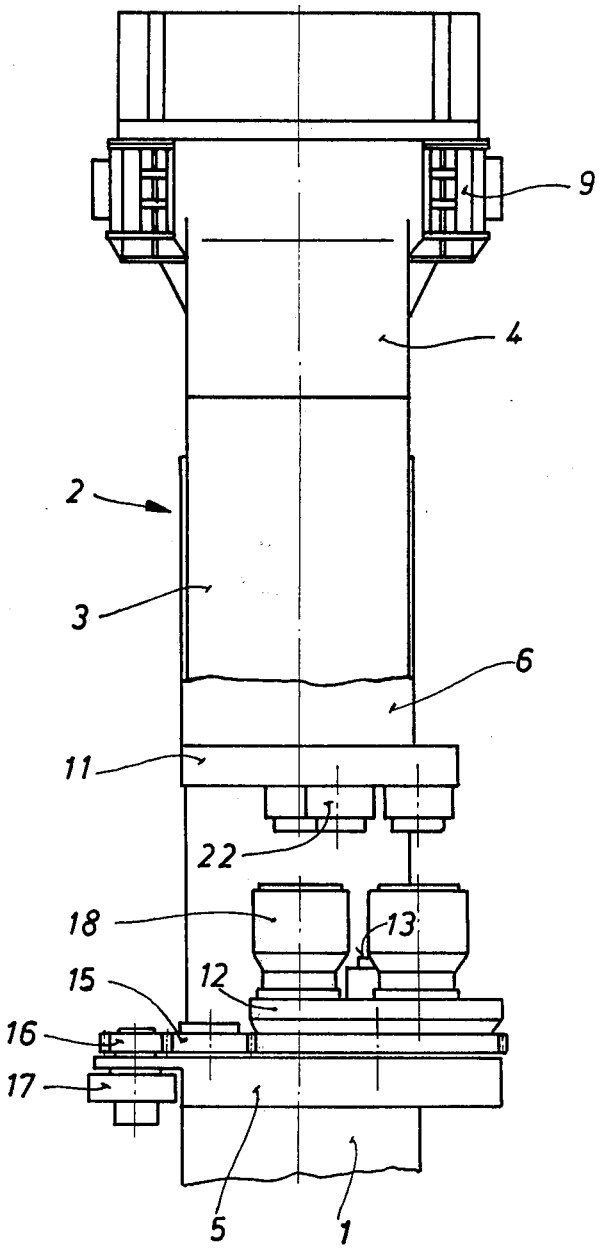
FIG. 2 is a side view of the apparatus.

In the drawings a screw press 2, comprising a support made up of four posts 3 and a top bridge 4, rests on a press table 1. A press plate 5 also rests on the table. A guided platen 6 is moveable up and down between the posts. A screw, not shown, is housed within the top bridge 4 and extends to platen 6 in screw housing 7. Platen 6 carries an internal nut which is mounted on the screw. When the screw is turned, the platen moves up and down with the nut. Above, at the top of bridge 4 the screw supports a flywheel 8 which is provided with gear teeth on its outer rim which mesh with two pinions driven by motor 9. Also at the top bridge are two brake mechanisms 10 for the flywheel 8.

The platen 6 carries a tool plate 11 on its underside. This plate extends forward a considerable distance over the support, beyond the two front posts 3. The press plate 5 also extends forward, even farther than the tool plate (see FIG. 1). A round rotary table 12 of moderate diameter is rotatably mounted on the press plate 5 by means of roller bearings, not shown. The rotational axis 13 of the rotary table lies within the cross sectional area of the support, in the forward quarter of it, near the imaginary boundary line passing through the forward sides of the two forward posts. The rotary table 12 is guied by a guided rail 14 which is mounted on the press table. Table 12 has gear teeth on its circumference which mesh with a gear wheel 15 mounted on press plate 5, which gear wheel in turn is rotated by a pinion 16 driven by a motor 17 mounted behind the press plate. Thus motor 17 is not mounted on the press plate.

Figure 4:
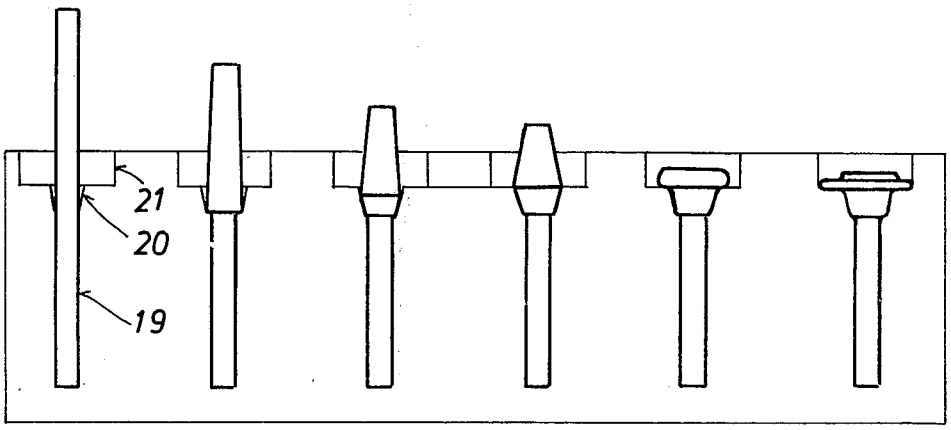
FIG. 4 is a schematic depiction of a workpiece in the form of a rod or bar, inserted in a lower die, shown after different forming operations with the apparatus according to FIGS. 1 through 3.

Three identical lower dies 18 ((I), (II), and (III)) are attached to rotary table 12 in a circle around the rotational axis 13. The interior shape of the cavity in a lower die is seen in FIG. 4. This comprises a lower, long, small-diameter region 19, directly above it a middle region 20 of conical shape widening upwardly, with no shoulder at the transition point, and finally above this, beyond a shoulder, an upper region 21 which is shorter and has a larger diameter. In the present case regions 19 and 21 have circular cross sections. The three lower dies 18 lie at equal angles of 120° from each other. By means of a motor 17 which is suitably controllable, the midpoints of the three lower dies 18 can be set a six different positions 0', 1', 2', 3', 4', and 5', around rotational axis 13, with adjacent positions being 60° apart. One of these positions (5') lies precisely in the middle of the cross sectional area of the press support, i.e., midway between the four posts 3.

Figure 3:
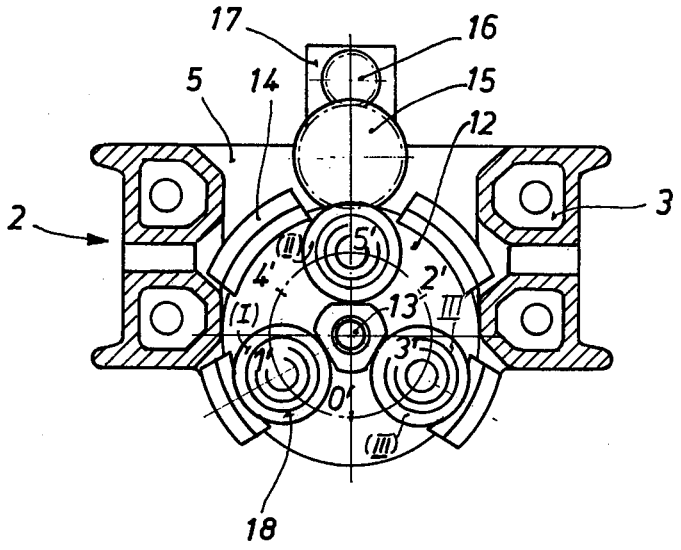
FIG. 3 is a cross section through line III-III in FIG. 1.

Up to five upper dies 22, corresponding to the number of forming operations to be carried out, are mounted on the underside of tool plate 11, each with a different shape depending on its forming operation. The shapes of these upper dies 22 correspond to the shapes which the workpieces are to have after the respective operations; these shapes are indicated in FIG. 4. Thus inner conical upper dies are provided for the first three operations in the sequence; the next upper die has an inner cylindrical shape; and the die for the final forming operation has a shape corresponding to the final form of the intended flanged product. The upper dies 22 are arrayed around rotational axis 13, 60° apart in a circle, with the exception that two are 120° apart. Two of the preforming upper dies are positioned in the projecting region of the tool plate 11 which is beyond the cross sectional area of the support. The upper dies for the individual sequential forming operations (1'), (2'), (3'), (4'), and (5') are laid out around the circle (as indicated in FIG. 3) in the order 1', 4', 5', 2', 3'; the position 0' is provided for between 1' and 3'.

The bar- or rod-shaped workpieces are partially heated in a furnace and picked up by manipulating tongs, not shown, at a loading station outside the press, whence they are swung over the lower die which is in position 0', e.g., dis (I), and inserted into the die partially protruding. Since in the present case four preforming operations are required, the inserted workpiece is swung from position 0' to position 1' by rotating the rotary table through 60°, whereafter the press platen is brought down to produce the first preform, which has a tapered shape. Then there is a rotation through 180° to position 2' where the second preforming operation is performed. Finally the rotary table is turned another 60° to bring the workpiece to position 3' for the third preforming operation, another 180° position 4' for the fourth preforming operation, and another 60° to position 5' for the finish-forging operation. After the finish-forging the workpiece is swung 180° back to position 0' where it is raised somewhat by an ejector, grasped by the manipulating tongs, and completely removed from the lower die. The manipulating tongs then swing away from the lower die and deposit the finished workpiece in a receiver.

Figure 5:
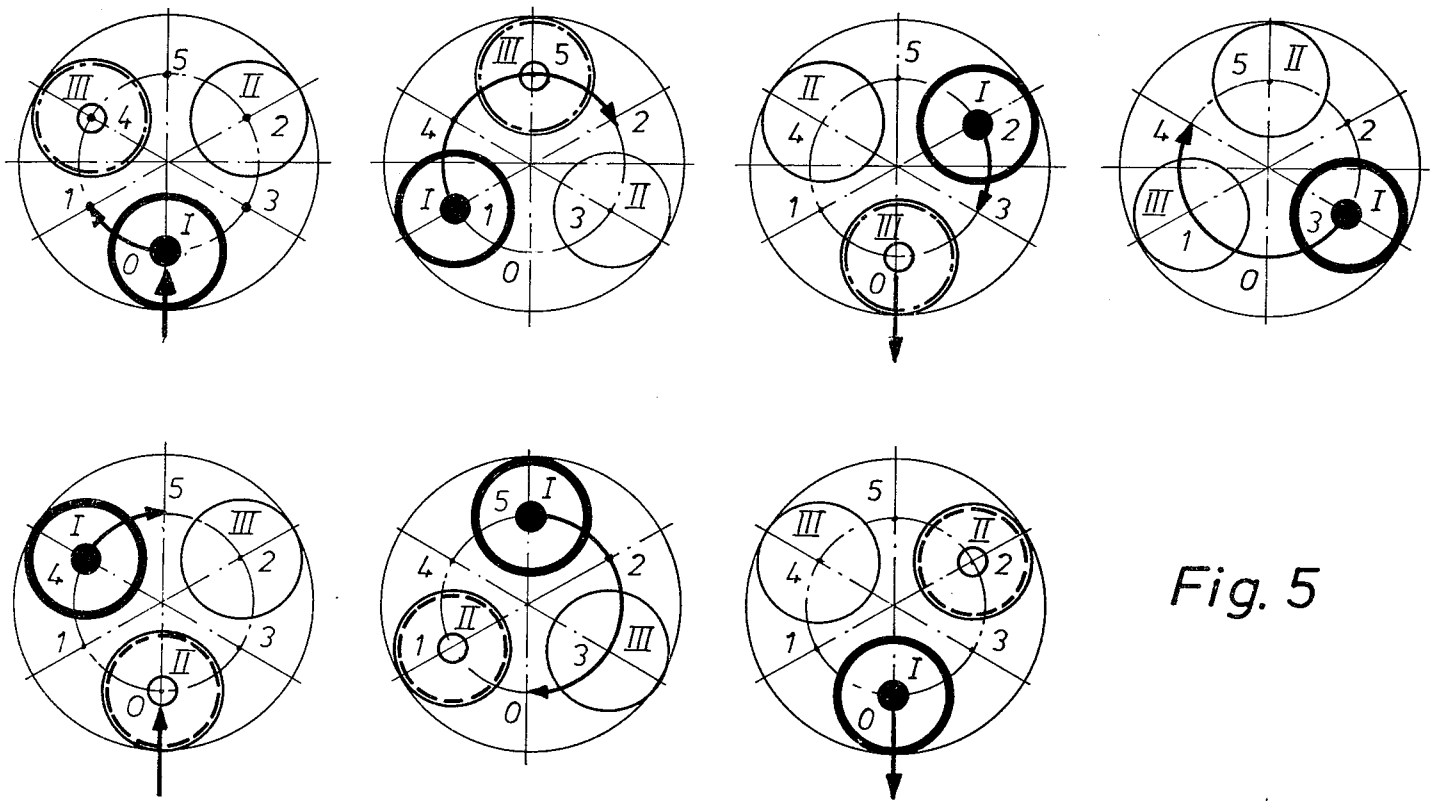
FIGS. 5, 6 and 7 are schematics of three different operation sequences which may be carried out with the apparatus according to FIGS. 1 through 3 with the addition of different upper dies depending on the shaft flange which is to be produced.
Figure 6:
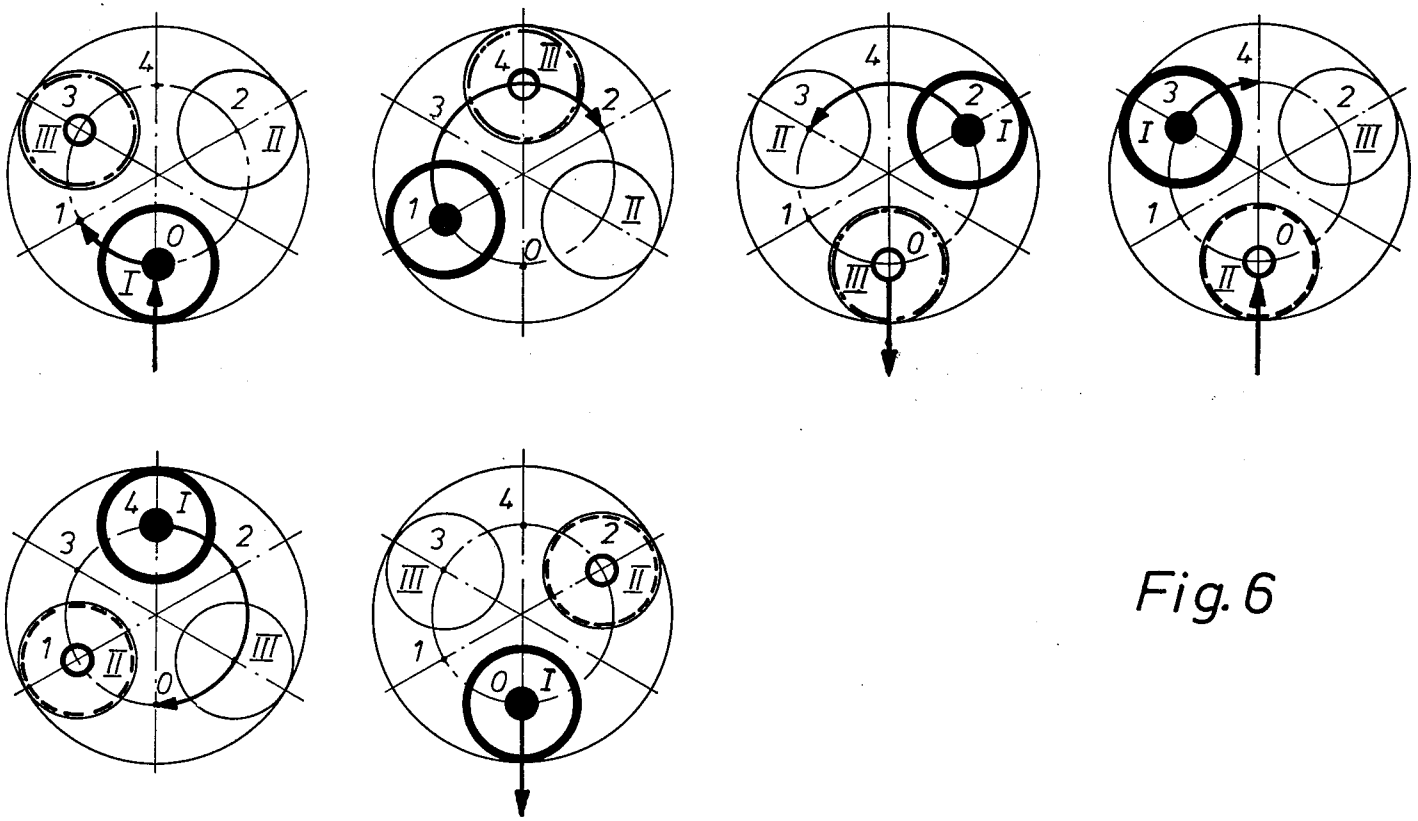
Figure 7:
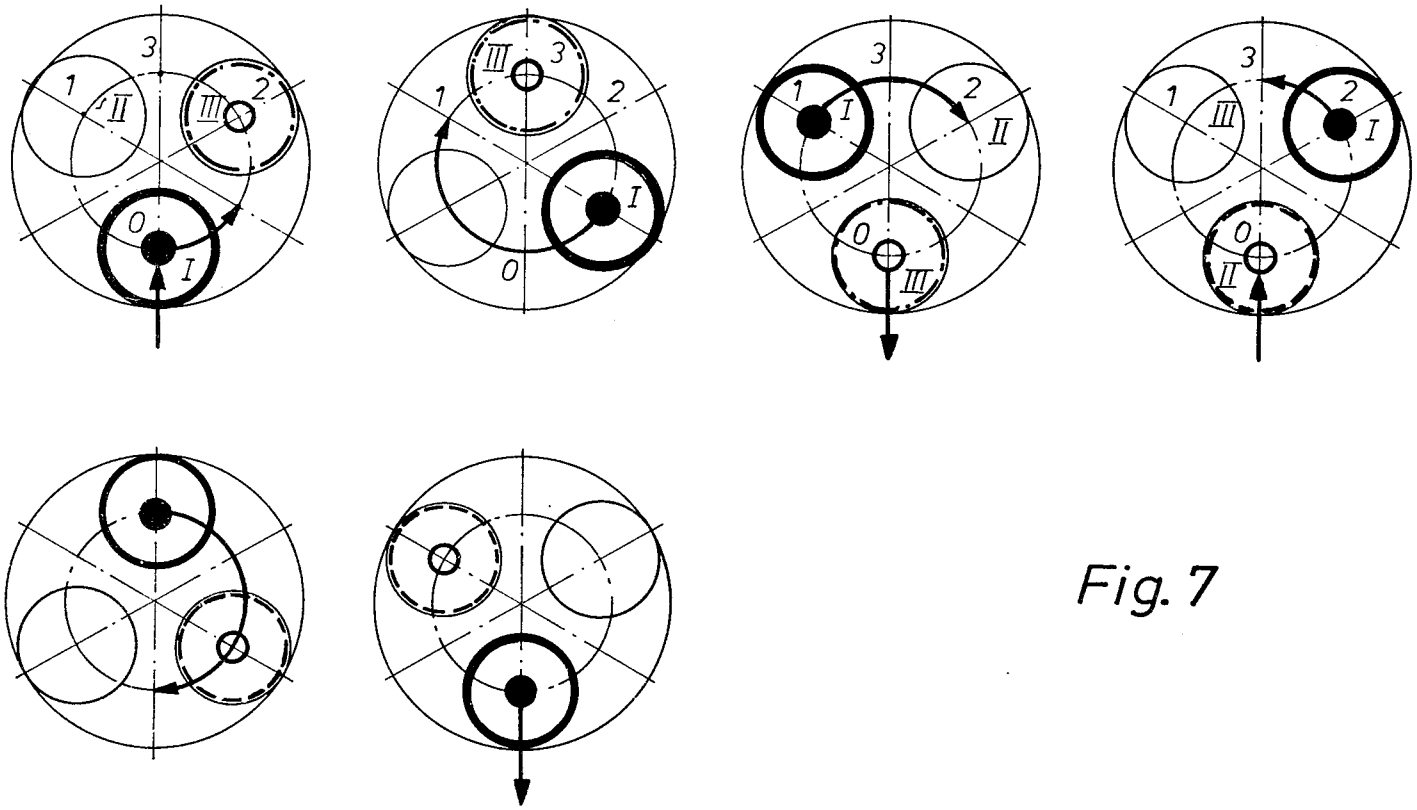

In each of FIGS. 5 through 7 three lower dies are provided. In FIG. 5 there are also five upper dies, in FIG. 6 four upper dies, and in FIG. 7 three upper dies, wherein in each case one of the dies serves for the finish-forging operation. The arrangement of the upper dies is seen particularly well in FIGS. 5 through 7.

A common factor in all three operation sequences depicted is that only one of the three lower dies is loaded with a workpiece at a given time, while the third lower die may be cooling off, getting greased, or getting blow-cleaned e.g., with steam. Each rotational step of the rotary table is 60° only, or an integral multiple of 60°. In all three sequences a die is swung from the first preforming station always past the centrally located finish-forging die to the second preforming station. The direction of rotation of the rotary table is shown in the individual representations.

I claim:

1. Apparatus for forging a shaft flange in one or more preforming operations and a finish-forging operation comprising a forging press having a support stand with a fixed press plate, a moving platen movable relative to said fixed plate, a rotatable table mounted on said fixed plate, an upper finish-forging die on said moving platen, said die being located substantially in alignment with a central axis of said support stand, said rotary table having an axis of rotation spaced from said central axis, a plurality of like lower dies supported in a circle on said table around said axis of rotation, a plurality of upper preforming dies on said moving platen for cooperation with said lower dies and means for indexing said table about said axis of rotation to bring a lower die containing a workpiece to be forged sequentially into register with said upper preforming dies and with said finish-forging die, a first one of said upper preforming dies being positioned on one side of said finish-forging die and a second one of said upper preforming dies being positioned on the other side of said finish-forging die, said indexing means being adapted to rotate a lower die from alignment with said first upper die to alignment with said second upper die past said finish-forging die.

2. The apparatus of claim 1 characterized in that the lower dies consist of three in number and are equally circumferentially spaced.

3. A forging press for forging a shaft flange on one end of a workpiece shaft in sequential preforming and finish-forging operations, comprising, a frame having a support stand and a fixed press plate, a platen supported on said support stand for forward and backward movement relative to said press plate, a rotatable table having a central rotational axis supported on said press plate between the moving platen and the press plate, at least three lower dies of identical structure supported on said rotatable table, a plurality of upper dies mounted on said moving platen, some of said dies being preforming dies constructed as hollow cones for the forming operations, and one upper die constructed to produce the form of the finished flange in the finish-forging operation, said rotatable table extending from the operational area of the moving platen for the purpose of emplacing the workpiece shaft into one of the lower dies, and said upper dies being located on a circle concentric with the axis of rotation of the rotatable table with one die on each side of said upper finish-forging die for one preforming operation.

4. The forging press of claim 3 wherein said upper and lower dies for the finish-forging operation are positioned approximately concentric to the cross section of the frame of the moving platen, and the moving platen is guided within the support stand of the frame.

5. The forging press of claim 3 or claim 4 wherein the lower dies consist of three in number and are equally circumferentially spaced.

6. The forging press of claim 3 or claim 4 wherein one of said upper preforming dies is at least partly located outside of the cross sectional area of said support stand.

7. The forging press of claim 3 or claim 4 wherein said fixed press plate extends outside of the cross sectional area of said support stand.

* * * * *